US009170527B2

(12) United States Patent
Ariizumi

(10) Patent No.: US 9,170,527 B2
(45) Date of Patent: Oct. 27, 2015

(54) IMAGE FORMING APPARATUS HAVING DEVELOPER REPLENISHMENT CONTROL

(71) Applicant: CANON KABUSHIKI KAISHA, Tokyo (JP)

(72) Inventor: Osamu Ariizumi, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 132 days.

(21) Appl. No.: 13/742,606

(22) Filed: Jan. 16, 2013

(65) Prior Publication Data

US 2013/0202318 A1 Aug. 8, 2013

(30) Foreign Application Priority Data

Feb. 3, 2012 (JP) ..... 2012-022282

(51) Int. Cl.
*G03G 15/08* (2006.01)
*G03G 15/00* (2006.01)

(52) U.S. Cl.
CPC ..... *G03G 15/0831* (2013.01); *G03G 15/0856* (2013.01); *G03G 15/0877* (2013.01); *G03G 15/5041* (2013.01); *G03G 2215/00037* (2013.01)

(58) Field of Classification Search
CPC ..... G03G 15/043; G03G 15/0824; G03G 15/0849; G03G 2215/00029; G03G 2215/00037; G03G 2215/00042; G03G 15/0831; G03G 15/0856; G03G 15/5041; G03G 15/0877
USPC ..... 399/27, 43, 49, 51, 59, 62
See application file for complete search history.

(56) References Cited

U.S. PATENT DOCUMENTS

| | | | | |
|---|---|---|---|---|
| 5,321,468 | A * | 6/1994 | Nakane et al. | 399/42 |
| 5,678,131 | A * | 10/1997 | Alexandrovich et al. | 399/58 |
| 6,115,561 | A * | 9/2000 | Fukushima | 399/49 |
| 7,027,746 | B2 * | 4/2006 | Suzuki et al. | 399/27 |
| 7,043,171 | B2 * | 5/2006 | Ogata | 399/61 |
| 7,218,870 | B2 | 5/2007 | Hirobe | |

(Continued)

FOREIGN PATENT DOCUMENTS

| | | |
|---|---|---|
| JP | 10-39608 A | 2/1998 |
| JP | 2001-305808 A | 11/2001 |

(Continued)

OTHER PUBLICATIONS

Chinese Office Action dated Oct. 20, 2014, in related Chinese Patent Application No. 201310037263.5 (with English translation).

*Primary Examiner* — Robert Beatty
(74) *Attorney, Agent, or Firm* — Fitzpatrick, Cella, Harper & Scinto

(57) ABSTRACT

An image forming apparatus includes an image bearing member and a developer replenishment device. In addition, a control portion executes a first mode of detecting a first toner image for control by a sensor and controlling an operation of the replenishment device so that a detection result from the sensor attains a first target value, a second mode of detecting a second toner image for control by the sensor and setting a development contrast of a maximum image density so that a detection result attains a second target value, and a third mode of detecting a third toner image for control by the sensor and changing, based on the detection result, at least one of the first target value and a development contrast of the first toner image for control, wherein the control portion executes the third mode according to a timing at which the second mode is executed.

3 Claims, 11 Drawing Sheets

(56) References Cited

U.S. PATENT DOCUMENTS

| | | | | |
|---|---|---|---|---|
| 8,121,499 | B2 | 2/2012 | Fujiwara | |
| 8,682,183 | B2 * | 3/2014 | Tanaka | 399/27 |
| 2005/0213999 | A1 | 9/2005 | Hirobe | |
| 2010/0067932 | A1 * | 3/2010 | Fujiwara | 399/55 |
| 2010/0272453 | A1 | 10/2010 | Fujiwara | |
| 2011/0280594 | A1 | 11/2011 | Tanaka | |

FOREIGN PATENT DOCUMENTS

| | | | | |
|---|---|---|---|---|
| JP | 2004126343 | A | * | 4/2004 |
| JP | 2005-274789 | A | | 10/2005 |
| JP | 2007-78896 | A | | 3/2007 |
| JP | 2008268679 | A | * | 11/2008 |
| JP | 2010-271692 | A | | 12/2010 |

* cited by examiner

IMAGE FORMING APPARATUS HAVING DEVELOPER REPLENISHMENT CONTROL

BACKGROUND OF THE INVENTION

1. Field of the Invention

The present invention relates to an image forming apparatus for controlling a replenishment quantity of a developer for a developing device based on a detection result of a toner borne-on quantity of a toner image for control, and more particularly, to control for replacing a part of control for ensuring reproducibility of an image density by adjustment of a toner charge with adjustment of a development contrast.

2. Description of the Related Art

In widely-used image forming apparatus, charged toner adheres to an electrostatic image formed on an image bearing member to develop into a toner image, the toner image is transferred to a recording material directly or through intermediation of an intermediate transfer member, and the recording material onto which the toner image has been transferred is heated and pressurized to fix an image on the recording material. As illustrated in FIG. 6B, in the image forming apparatus, the toner image is developed so that a development contrast VcontG1 being a potential difference between a potential of a developer carrying member and a potential of the electrostatic image is compensated with a total electricity amount of the charged toner.

Therefore, as a toner charge amount Q/M of the developer inside a developing device becomes higher, a toner borne-on quantity of the toner image obtained by developing a predetermined electrostatic image becomes smaller, and an image density becomes lower. On the other hand, as the toner charge amount Q/M of the developer inside the developing device becomes lower, the toner borne-on quantity of the toner image obtained by developing the predetermined electrostatic image becomes larger, and the image density becomes higher.

Accordingly, in the conventional image forming apparatus, control for maintaining the toner charge amount Q/M of the developer inside the developing device at a fixed level at all times is executed in order to enhance reproducibility of the image density (Japanese Patent Application Laid-Open No. H10-039608 and Japanese Patent Application Laid-Open No. 2005-274789).

In the image forming apparatus disclosed in Japanese Patent Application Laid-Open No. H10-039608, a fixed first development contrast is set for each image formation of a predetermined number of sheets to form a first toner image for measurement (ATR patch), and the ATR patch is detected by an optical sensor to measure the toner borne-on quantity. Then, a developer replenishment quantity for each image formation obtained by a video count method is adjusted based on output information from the optical sensor.

In the image forming apparatus disclosed in Japanese Patent Application Laid-Open No. 2005-274789, the adjustment of a development contrast at a time of image formation which uses a second toner image for measurement (Dmax patch) is performed at a frequency lower than that of the adjustment of the developer replenishment quantity which uses the first toner image for measurement. A so-called Dmax control for forming a Dmax patch having the highest density level (image ratio of 100%; solid image) and adjusting a second development contrast used for the image formation is executed. Then, in order to reduce an error in the developer replenishment quantity due to a change in temperature/humidity, the first development contrast used for developer replenishment quantity adjustment is corrected based on a relationship between the toner borne-on quantity and the development contrast obtained in the Dmax control.

In the image forming apparatus disclosed in Japanese Patent Application Laid-Open No. H10-039608 and Japanese Patent Application Laid-Open No. 2005-274789, a replenishment quantity of a replenishment developer is adjusted so that a toner charge amount of the developer is maintained at a fixed level from beginning to end. If the toner borne-on quantity of a patch toner image is small, the toner charge amount Q/M is lowered by increasing a toner replenishment quantity for the developing device and reducing a friction opportunity of the toner for a carrier, to thereby increase the toner borne-on quantity of the image. On the other hand, if the toner borne-on quantity of the patch toner image is large, the toner charge amount Q/M is increased by reducing the toner replenishment quantity for the developing device and increasing the friction opportunity of the toner for the carrier, to thereby reduce the toner borne-on quantity of the image.

If the image formation exhibiting extremely small toner consumption is continuously performed, the number of times of causing friction of the toner for the carrier increases, and hence the toner charge amount Q/M rises, while the toner borne-on quantity of the patch toner image decreases. If the toner continues to be supplied excessively in order to ensure the reproducibility of the image density by lowering the toner charge amount Q/M, a toner concentration of the developer (weight ratio of the toner to the developer) exceeds an upper limit value (for example, 11%). If the toner concentration exceeds the upper limit value, a normal operation of the developing device can no longer be continued.

On the other hand, if the image formation exhibiting extremely high toner consumption is continuously performed, the number of times of causing friction of the toner for the carrier decreases, and hence the toner charge amount Q/M decreases, while the toner borne-on quantity of the patch toner image increases. If toner replenishment continues to be stopped in order to ensure the reproducibility of the image density by raising the toner charge amount Q/M, the toner concentration of the developer drops below a lower limit value (for example, 5%). If the toner concentration drops below the lower limit value, the normal operation of the developing device can no longer be continued.

In recent years, the developing device is downsized along with a downsizing of the image forming apparatus, and the developer quantity being a denominator becomes smaller, while a maximum replenishment quantity per unit time of the replenishment developer being a numerator increases along with an increase in productivity of the image forming apparatus. Therefore, the toner charge amount Q/M of the developer inside the developing device becomes easy to fluctuate, and the toner concentration becomes easy to fluctuate along with the toner replenishment and toner replenishment restriction. Therefore, if the image formation exhibiting extremely small toner consumption is continuously performed, the toner concentration of the developer inside the developing device reaches the upper limit value in an extremely short period of time. If the image formation exhibiting extremely large toner consumption is continuously performed, the toner concentration of the developer reaches the lower limit value in an extremely short period of time.

SUMMARY OF THE INVENTION

The present invention provides an image forming apparatus capable of keeping a toner concentration of a developer within a tolerance range over a long term even if image formation exhibiting extremely small toner consumption is continuously performed or if image formation exhibiting extremely large toner consumption is continuously performed.

An image forming apparatus according to an example of the present invention includes: an image bearing member; an electrostatic image forming device which forms an electrostatic image on the image bearing member; a developing device which develops the electrostatic image on the image bearing member by causing a developer including toner to be carried on a developer carrying member; a replenishment device which replenishes the developing device with the developer; a sensor which detects a toner image for control that is used for control of image formation and which outputs information corresponding to a toner borne-on quantity; and a control portion capable of respectively executing, a first mode of detecting a first toner image for control by the sensor and controlling an operation of the replenishment device so that a detection result from the sensor attains a first target value, a second mode of detecting a second toner image for control by the sensor and setting a development contrast of a maximum image density so that a detection result from the sensor attains a second target value, and a third mode of detecting a third toner image for control by the sensor and changing, based on the detection result detected by the sensor, at least one of the first target value and a development contrast of the first toner image for control.

Further features of the present invention will become apparent from the following description of exemplary embodiments with reference to the attached drawings.

DESCRIPTION OF THE EMBODIMENTS

In the following, embodiments of the present invention are described in detail with reference to the accompanying drawings. The present invention can also be carried out in another embodiment obtained by replacing a part or all of components of the embodiments with components alternative thereto as long as a part of developer replenishment control based on patch detection ATR is replaced with development contrast adjustment.

The present invention can be carried out in any one of image forming apparatus of a tandem type/one-drum type, an intermediate transfer type/recording material transport type, and a sheet-fed transfer type. In the intermediate transfer type, a toner borne-on quantity of a patch toner image may be detected not only on an image bearing member but also on an intermediate transfer member. The image bearing member is not limited to an organic photosensitive member, and an inorganic photosensitive member such as an amorphous silicon photosensitive member may be used. Further, the image bearing member is not limited to a photosensitive drum, and a belt-like photosensitive member may be used. A charging method, a developing method, a transferring method, a cleaning method, and a fixing method can also be selected arbitrarily. A developing device is not limited to a vertical type in which a developing chamber and an agitating chamber are arranged vertically, and may be of a horizontal type in which the developing chamber and the agitating chamber are arranged horizontally in alignment. The developing device may be of a so-called hybrid type for supplying only the toner to the magnetic brush roller on which a carrier is borne.

In this embodiment, only main portions relating to formation/transfer of the toner image are described. The present invention can be implemented in an image forming apparatus for various applications, such as a printer, various printing machines, a copier, a FAX, and an MFP, by adding necessary devices, equipment, and casing structure.

(Image Forming Apparatus)

Figure 1:
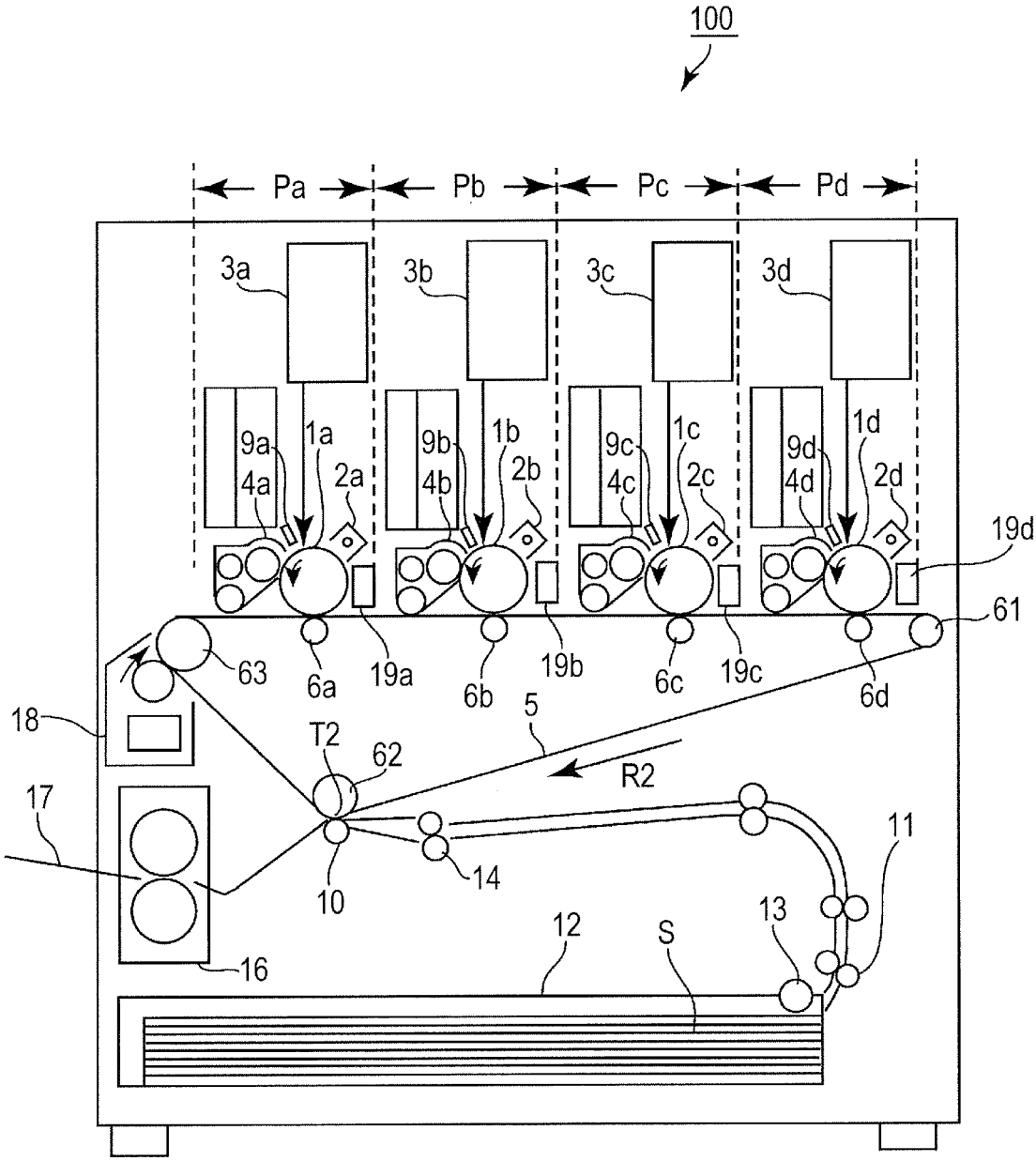
FIG. 1 illustrates a structure of an image forming apparatus.

FIG. 1 is an explanatory diagram illustrating a structure of the image forming apparatus. As illustrated in FIG. 1, an image forming apparatus 100 is a full-color printer of a tandem type and an intermediate transfer type, including image forming portions Pa, Pb, Pc, and Pd of yellow, magenta, cyan, and black arranged along an intermediate transfer belt 5.

In the image forming portion Pa, a yellow toner image is formed on a photosensitive drum 1*a* and is then transferred to the intermediate transfer belt 5. In the image forming portion Pb, a magenta toner image is formed on a photosensitive drum 1*b* and is then transferred to the intermediate transfer belt 5. In the image forming portions Pc and Pd, a cyan toner image and a black toner image are formed on photosensitive drums 1*c* and 1*d*, respectively, and are then transferred to the intermediate transfer belt 5.

The intermediate transfer belt 5 is stretched around a drive roller 61, an opposing roller 62, and a tension roller 63, and is free to move in an arrow R2 direction. A four-color toner image transferred onto the intermediate transfer belt 5 is transported to a secondary transfer portion T2 and secondarily transferred onto a recording material S. The recording materials S taken out from a recording material cassette 12 by a pickup roller 13 are separated sheet by sheet by the separation rollers 11 to be fed to registration rollers 14. The registration rollers 14 send out the recording material S to the secondary transfer portion T2 at a timing corresponding to the toner image on the intermediate transfer belt 5. The recording material S onto which the toner image has been transferred is heated and pressurized by a fixing device 16 to have the toner image fixed to a surface thereof, and is then delivered to a delivery tray 17.

The image forming portions Pa, Pb, Pc, and Pd have substantially the same structure except that different colors of toner are used in developing devices 4*a*, 4*b*, 4*c*, and 4*d*, respectively. In the following, a general image forming portion P obtained by removing respective suffixes a, b, c, and d expressing distinctions among the image forming portions Pa, Pb, Pc, and Pd is described, and duplicate descriptions relating to the image formation portions Pa, Pb, Pc, and Pd are omitted.

In the image forming portion P, a corona charger 2, an exposure device 3, a potential sensor 9, a developing device 4, a primary transfer roller 6, and a drum cleaning device 19 are arranged around a photosensitive drum 1. The photosensitive drum 1 has an outer peripheral surface of an aluminum cylinder on which a photosensitive layer to which a charge polarity having a negative polarity is imparted is formed, and rotates in a direction indicated by the arrow at a process speed (peripheral speed) of 300 mm/sec. The corona charger 2 charges a surface of the photosensitive drum 1 uniformity to a dark-part potential VD having a negative polarity based on a detection result for a surface potential detected by the potential sensor 9. The exposure device 3 scans a laser beam by using a rotating mirror, and writes an electrostatic image of the image onto the charged surface of the photosensitive drum 1. The developing device 4 develops the electrostatic image to form the toner image on the surface of the photosensitive drum 1.

The primary transfer roller 6 presses an inner side surface of the intermediate transfer belt 5 to form a transfer part for the toner image between the photosensitive drum 1 and the intermediate transfer belt 5. By applying a direct-current voltage having a positive polarity to the primary transfer roller 6, the toner image having a negative polarity borne on the photosensitive drum 1 is primarily transferred onto the intermediate transfer belt 5. The drum cleaning device 19 collects transfer residual toner remaining on the photosensitive drum 1 without having been transferred onto the recording material S.

(Developing Device)

Figure 2:
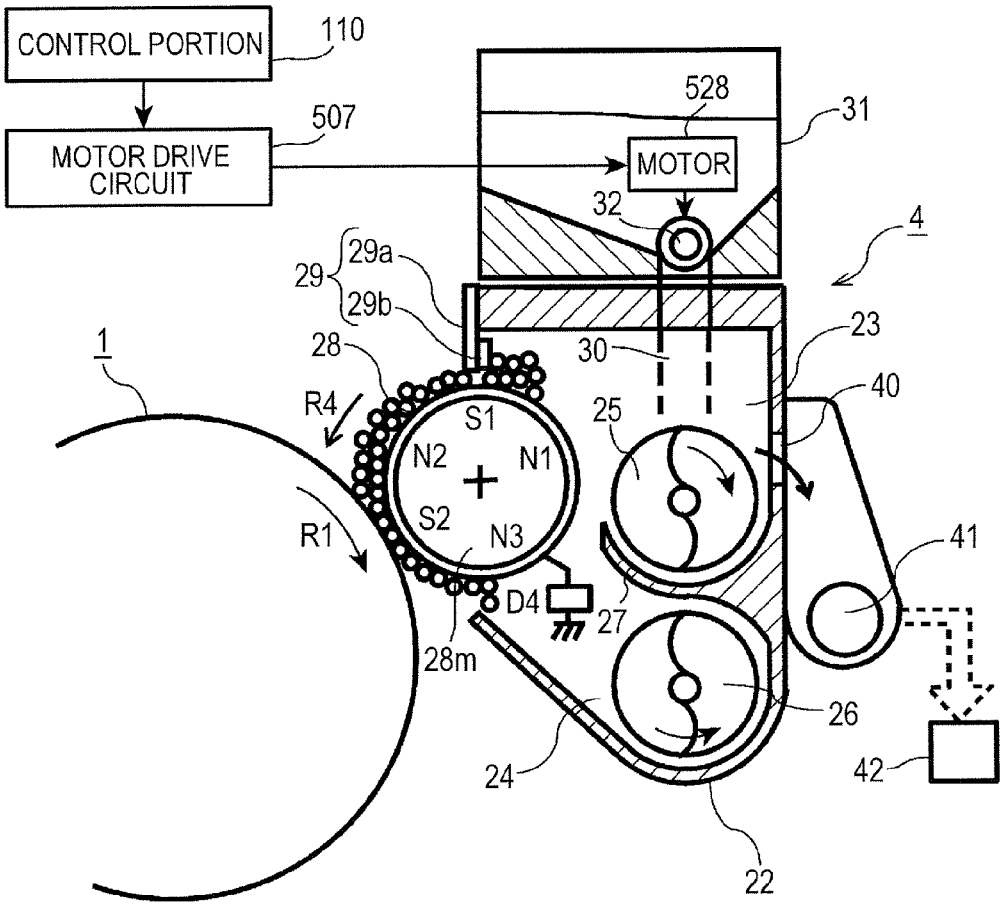
FIG. 2 illustrates a structure of a cross-section of a developing device along a direction perpendicular to an axis thereof.
Figure 3:
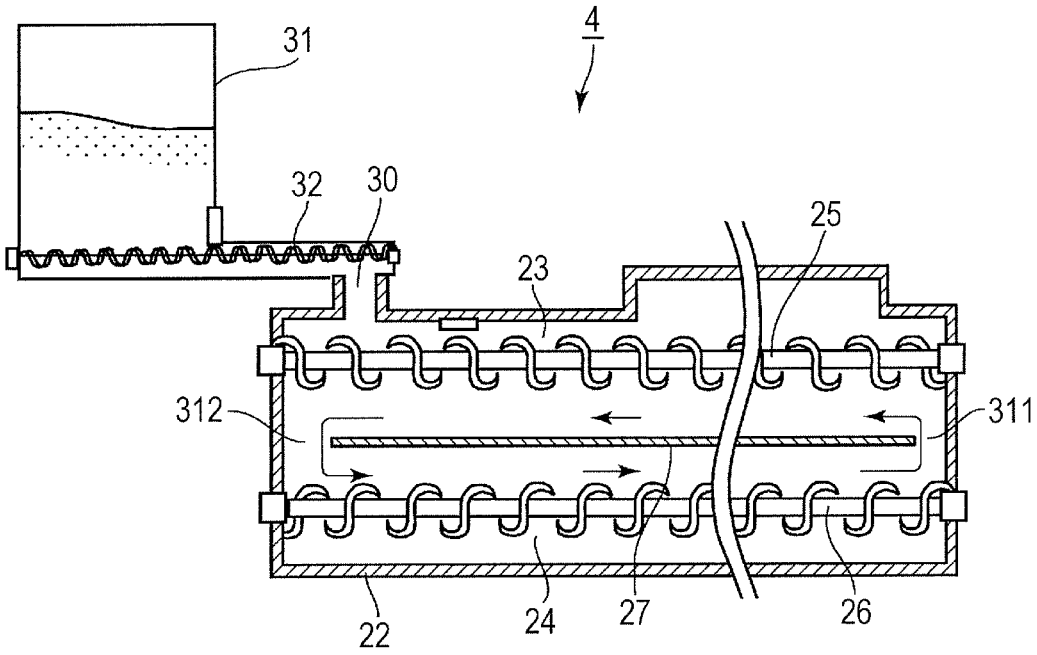
FIG. 3 illustrates a structure of a cross-section of the developing device along a direction parallel to the axis thereof.

FIG. 2 is an explanatory diagram of a structure of a cross-section of the developing device along a direction perpendicular to an axis thereof. FIG. 3 is an explanatory diagram of a structure of a cross-section of the developing device along a direction parallel to the axis thereof.

As illustrated in FIG. 2, the developing device 4 is a developing device of a vertically-agitating type in which a developing chamber 23 and an agitating chamber 24 are arranged in alignment in the perpendicular direction. The developing device 4 includes a developing container 22, and the developer including the toner and the carrier is stored in the developing container 22.

An opening portion is provided in a position of the developing container 22 corresponding to a developing region opposed to the photosensitive drum 1, and a developing sleeve 28 is rotatably disposed in the opening portion so as to be partially exposed toward the photosensitive drum 1. The developing sleeve 28 rotates in an arrow R4 direction (counterclockwise direction) at a time of development of the electrostatic image, and bears and carries the developer whose layer thickness is regulated by a regulating blade 29 to the developing region of the photosensitive drum 1. The developing sleeve 28 supplies the developer to the electrostatic image formed on the photosensitive drum 1 to develop the electrostatic image into the toner image.

The developing sleeve 28 is formed of a non-magnetic material such as aluminum or stainless steel. The developing sleeve 28 has a diameter of 20 mm. The photosensitive drum 1 has a diameter of 40 mm. A rotation number of the developing sleeve 28 at the time of the image formation is set to 492 rpm, and a ratio of the peripheral speed of the developing sleeve 28 to the peripheral speed of the photosensitive drum 1 is set to 180%.

A magnet roller 28*m* is placed inside the developing sleeve 28 in a non-rotation state. The magnet roller 28*m* has a development pole S2 located so as to be opposed to the photosensitive drum 1 and a magnetic pole S1 located so as to be opposed to the regulating blade (bristle cutting member) 29. The magnet roller 28*m* has a magnetic pole N2 located between the magnetic pole S1 and the development pole S2 and magnetic poles N1 and N3 located so as to be opposed to the developing chamber 23 and the agitating chamber 24, respectively. A clearance between the developing sleeve 28 and the photosensitive drum 1 that are opposed to each other is set to approximately 380 μm, and hence development can be performed by bringing a magnetic bristle tip of the developer, which is raised on a surface of the developing sleeve 28 due to a magnetic flux from the development pole S2, into contact with the photosensitive drum 1.

The regulating blade 29 for regulating the layer thickness of the developer borne on the developing sleeve 28 is disposed so as to have a tip thereof opposed to the developing sleeve 28. The regulating blade 29 is formed by overlaying a magnetic member 29*b* made of an iron material on a non-magnetic member 29*a* that is formed of aluminum to have a plate shape and disposed along a generating line of a cylindrical surface of the developing sleeve 28. The regulating blade 29 is disposed on an upstream side with respect to the photosensitive drum 1 in a rotational direction of the developing sleeve 28.

The developer passes through a clearance between the tip of the regulating blade 29 and the developing sleeve 28, and is sent to the developing region while being leveled at a fixed layer thickness. By adjusting the clearance between the regulating blade 29 and the developing sleeve 28, a bristle cutting quantity of the magnetic brush of the developer borne on the developing sleeve 28 is regulated, and a developer quantity to be carried to the developing region of the photosensitive drum 1 is adjusted. Here, the clearance between the regulating blade 29 and the developing sleeve 28 is set to 580 μm so that a developer coat quantity per unit area of the developer to be carried to the developing region of the photosensitive drum 1 is regulated at 30 mg/cm$^2$. The clearance between the regulating blade 29 and the developing sleeve 28 can be set to 200 to 1,000 μm, and is preferred to be set to 400 to 700 μm.

An inside of the developing container 22 is partitioned vertically into the developing chamber 23 and the agitating chamber 24 by a partition wall 27 that extends in a direction perpendicular to the drawing sheet at a center in a height direction.

As illustrated in FIG. 3, a developing screw 25 is disposed in the developing chamber 23. The developing screw 25 is disposed in a bottom part of the developing chamber 23 substantially in parallel to an axial direction of the developing sleeve 28. The developing screw 25 rotates to carry the developer inside the developing chamber 23 in one direction along a direction of an axial line. The developing screw 25 has a shape having an outer diameter of Φ20 mm, an axial diameter of 6 mm, and a pitch of 25 mm with a rotation speed set to 650 rpm.

An agitating screw 26 is disposed in the agitating chamber 24. The agitating screw 26 is disposed in a bottom part of the agitating chamber 24 substantially in parallel to the developing screw 25. The agitating screw 26 carries the developer inside the agitating chamber 24 in a direction opposite to that of the developing screw 25. The agitating screw 26 has a shape having an outer diameter of Φ20 mm, an axial diameter of 6 mm, and a pitch of 25 mm. The agitating screw 26 requires more carrying power than the developing screw 25, and is therefore has the rotation speed set to 680 rpm.

The developing chamber 23 and the agitating chamber 24 communicate to each other through opening portions 311 and 312 respectively formed in both end portions of the partition wall 27. The developer carried by the developing screw 25 across the developing chamber 23 falls into the agitating chamber 24 through the opening portion 312. The developer carried by the agitating screw across the agitating chamber 24 is pushed up to the developing chamber 23 through the opening portion 311. In this manner, in a process in which the developer is circulated inside the developing container 22 while being agitated, friction is caused between the toner and the carrier within the developer to charge the toner to negative and the carrier to positive.

(Developer Replenishment Device)

In the image forming apparatus for forming a full-color image by an electrophotographic process, from the viewpoint of a color tint of the image or the like, most of the developing devices use the developer whose main ingredients are the non-magnetic toner and the magnetic carrier. A toner concentration of the developer is an extremely important factor in stabilizing image quality. The toner concentration (ratio of the weight of the toner to a total weight of the carrier and the toner) is defined as a ratio of the weight of the toner to the weight of the developer.

As illustrated in FIG. 2, a hopper 31 for storing a developer for replenishment obtained by mixing the toner and the carrier is disposed in a top part of the developing device 4. A replenishing screw 32 for cutting out the developer along with the rotation to replenish the developing chamber 23 therewith is disposed in a lower part of the hopper 31. As illustrated in FIG. 3, one end of the replenishing screw 32 extends up to a position of a developer replenishment port 30 provided in a front end portion of the developing device 4.

A quantity of a replenishment developer for compensating a toner quantity consumed by the image formation passes from the hopper 31 through the developer replenishment port 30 due to a rotational force of the replenishing screw 32 and a gravity force to replenish the developing container 22 of the developing device 4. A replenishment quantity of the replenishment developer is adjusted based on the rotation number of the replenishing screw 32. The replenishment quantity of the replenishment developer and the rotation number of the replenishing screw 32 are determined by a control portion 110.

Only the toner is relocated from the developing sleeve 28 to the photosensitive drum 1 along with the image formation, which lowers the toner concentration of the developer that is circulated inside the developing container 22. In video count ATR control described later, the control portion 110 obtains toner consumption for each image formation to calculate the replenishment quantity of the replenishment developer, and sends a toner replenishment signal to a motor drive circuit 507. The motor drive circuit 507 drives a motor 528 for only a time period corresponding to the toner replenishment signal to rotate the replenishing screw 32 and to supply a proper quantity of replenishment developer from the hopper 31 to the developing container 22. With this operation, the toner concentration of the developer inside the developing container 22 is recovered.

The replenishment developer includes 90% of toner and 10% of carrier in terms of the weight ratio. The developer inside the developing container 22 that has become excessive due to the replenishment with the replenishment developer including the 10% of carrier overflows from a delivery opening portion 40 to be carried by a delivery screw 41 and collected into a collecting container 42. With this operation, along with the circulation inside the developing container 22, the carrier whose charging performance has been lowered is gradually replaced with the new carrier.

In the video count ATR control, toner replenishment is performed based on an estimated value of the toner consumption, and hence an error in the toner replenishment using the replenishment developer accumulates so that the toner concentration of the developer sometimes becomes inappropriate. Therefore, a sensor (not shown) for optically or magnetically detecting the toner concentration of the developer being circulated to issue an alarm is disposed in the developing container 22.

(Video Count ATR Control)

Figure 4:
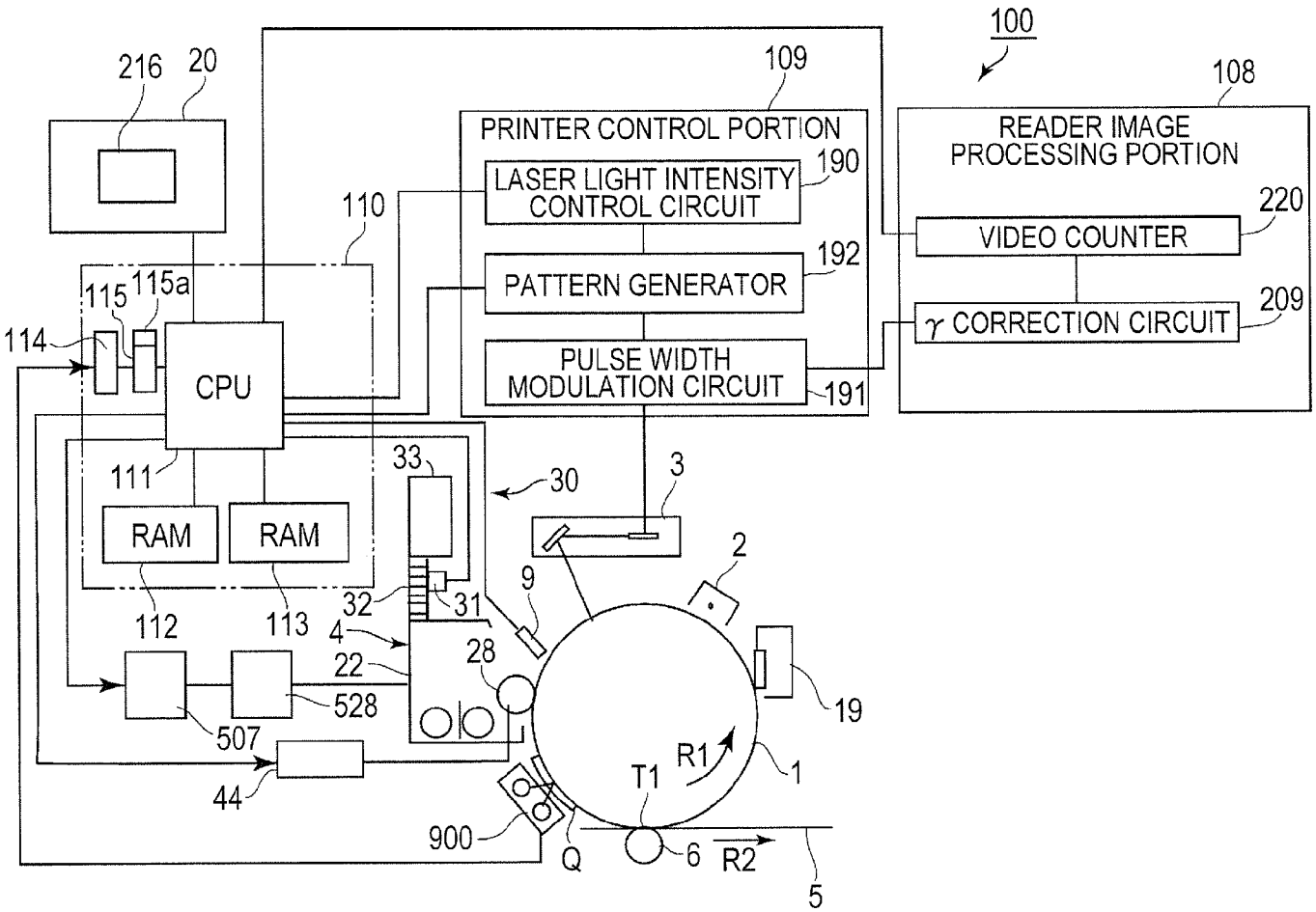
FIG. 4 is a block diagram of a control system for image density control performed in the image forming apparatus.

FIG. 4 is a block diagram of a control system for image density control performed in the image forming apparatus.

As illustrated in FIG. 4, in the developing device 4, only the toner is consumed from the developer inside the developing container 22 through the developing sleeve 28 along with the image formation, which lowers the toner concentration of the developer. Therefore, the control portion 110 executes the video count ATR control to replenish the developing container 22 with the replenishment developer from the hopper 31 so as to quickly compensate only the consumed toner. The video count ATR control is executed for the image formation of each sheet to count exposure dots of an area coverage modulation of the image, estimates the toner consumption, and determines the replenishment quantity of the replenishment developer.

A reader image processing portion 108 expands image data and creates a digital image signal for each pixel for scanning line writing. A video counter 220 integrates an output level of the digital image signal for each pixel, and estimates the toner quantity for each color used for the image formation for one sheet. The video counter 220 integrates the output level of the digital image signal for each pixel, converts the output level into a video count number, and sends the video count number to the control portion 110.

The control portion 110 converts the video count number into the replenishment quantity of the replenishment developer, and sends it to the motor drive circuit 507 as the toner replenishment signal. The motor drive circuit 507 drives the motor 528 for only the time period corresponding to the toner replenishment signal to supply the proper quantity of replenishment developer inside the hopper 31 to the inside of the developing container 22.

(Patch Toner Image)

Figure 5:
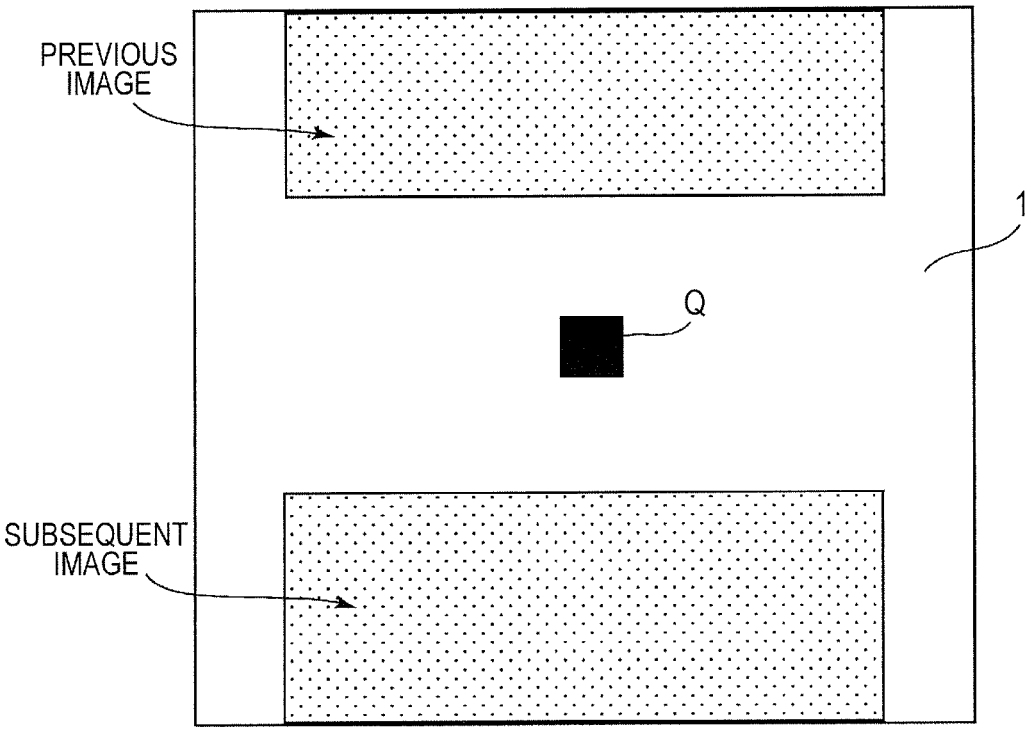
FIG. 5 illustrates placement of a patch toner image.
Figure 6A:
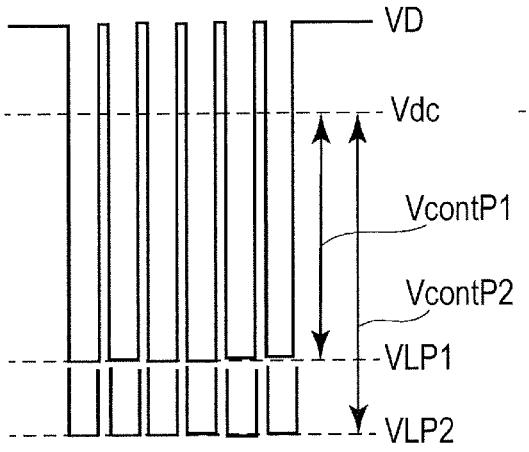
FIG. 6A illustrates a development contrast of an electrostatic image of a patch image.
Figure 6B:
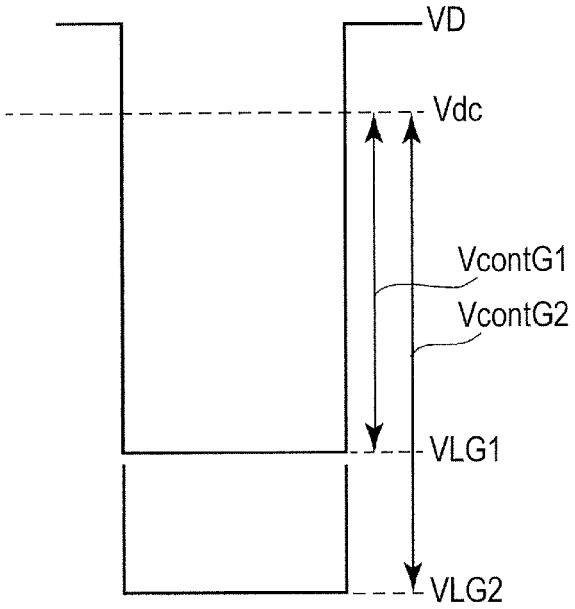
FIG. 6B illustrates a development contrast of an electrostatic image of an image having highest density level.
Figure 7:
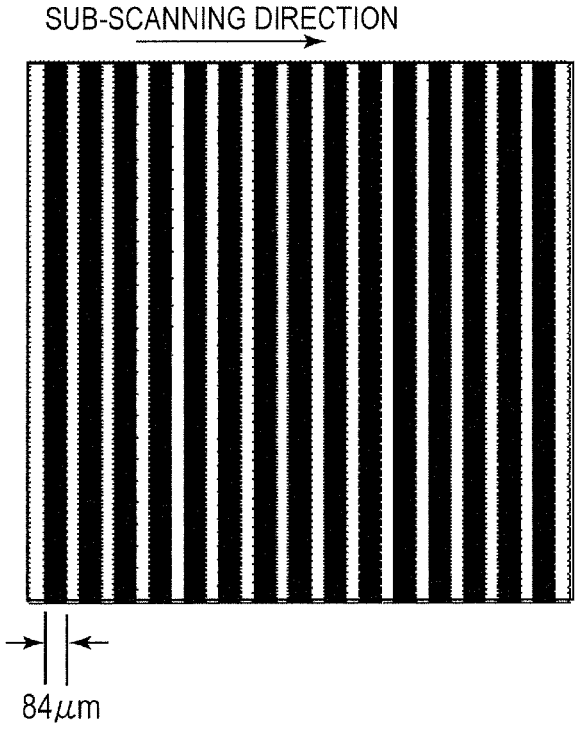
FIG. 7 illustrates an area coverage modulation.
Figure 8:
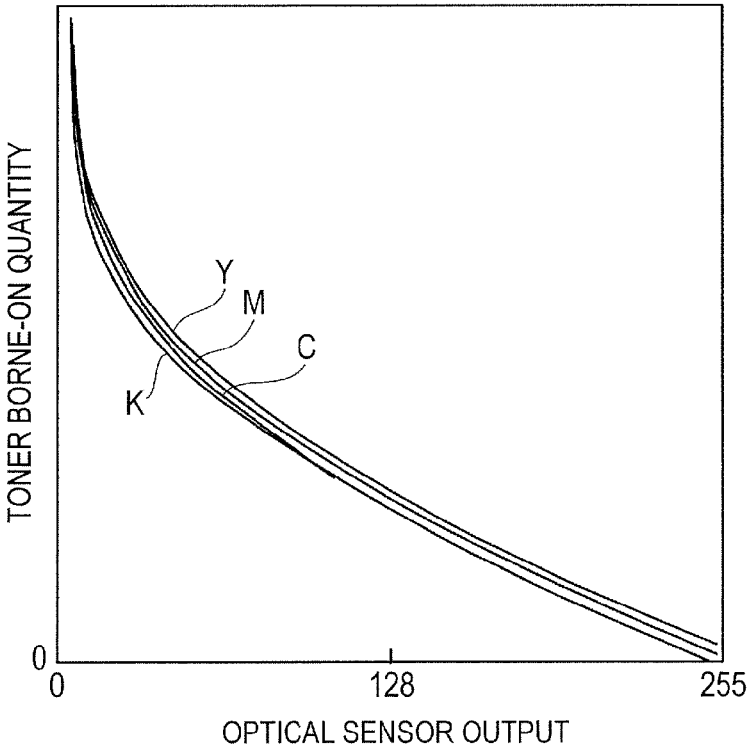
FIG. 8 shows a change in the output from an optical sensor in accordance with the area coverage modulation.

FIG. 5 is an explanatory diagram of placement of the patch toner image. FIGS. 6A and 6B are explanatory diagrams of a development contrast of the patch toner image. FIG. 7 is an explanatory diagram of the area coverage modulation. FIG. 8 is an explanatory diagram of a change of an output from an optical sensor in accordance with the area coverage modulation.

As illustrated in FIG. 5, for example, a patch toner image (reference image) Q is formed by enlarging an interval between the toner image of the image and the toner image of the image. In patch detection ATR control described later, the replenishment quantity of the replenishment developer based on video count ATR is adjusted in accordance with the toner borne-on quantity of a halftone patch toner image (ATR patch) formed on the photosensitive drum 1. In Dmax control described later, the development contrast at the time of the image formation is adjusted in accordance with the toner borne-on quantity of a patch toner image having the highest density level (Dmax patch) which is formed on the photosensitive drum 1.

As illustrated in FIG. 4, a printer control portion 109 controls a semiconductor laser of the exposure device 3 to write an electrostatic image onto the photosensitive drum. A patch image signal generating circuit (pattern generator) 192 generates a patch image signal having a signal level corresponding to a predetermined image density for forming the patch toner image. At a time of formation of the patch toner image, a pulse width modulation circuit 191 generates a laser driving pulse having a pulse width corresponding to the predetermined density in accordance with the patch image signal received from the pattern generator 192. The laser driving pulse is supplied to the semiconductor laser of the exposure device 3. The semiconductor laser emits light for only the time period corresponding to the pulse width to scan and expose the photosensitive drum 1. With this operation, a patch electrostatic image corresponding to the predetermined density is formed on the photosensitive drum 1. The patch electrostatic image is developed by the developing device 4, and the patch toner image Q is developed on the photosensitive drum 1.

Referring to FIG. 4, as illustrated in FIG. 6B, the photosensitive drum 1 is negatively charged to the uniform dark-part potential VD by the corona charger 2. After that, a part scanned and exposed by the laser beam is discharged to a bright-part potential VL, and the electrostatic image corresponding to the image signal is formed on the photosensitive drum 1. The electrostatic image on the photosensitive drum 1 is developed into the toner image when the toner moves from the developing sleeve 28 to the electrostatic image. At this time, a development contrast VcontG1 being a potential difference between a direct-current voltage Vdc applied to the developing sleeve and a bright-part potential VLG1 of the electrostatic image is compensated with electric charges of charged toner. Accordingly, when the development contrast VcontG1 is increased, the toner quantity relocated to the electrostatic image increases, and the toner borne-on quantity of the patch toner image becomes larger, which raises a patch image density at the time of transferring and fixing the patch toner image onto a recording material.

The development contrast VcontG1 is the potential difference between the direct-current voltage Vdc applied to the developing sleeve 28 and the bright-part potential VLG1 of the photosensitive drum 1. An electricity amount of the development contrast VcontG1 is compensated with the charging electric charges of a countless number of toner particles adhering to the light exposure region exhibiting the bright-part potential VL, to thereby develop the electrostatic image into the toner image.

Even without transferring and fixing the patch toner image Q onto the recording material, the toner borne-on quantity of the patch toner image Q formed on the photosensitive drum 1 can be detected as an intensity of specular reflection at a time of irradiating the surface of the photosensitive drum 1 with detection light, or as a reflectivity of the surface of the photosensitive drum 1. An optical sensor 900 for detecting the image density of the patch toner image Q is disposed on a downstream side of the developing device 4 so as to be opposed to the photosensitive drum 1. The optical sensor 900 includes a light-emitting portion provided with the light-emitting element such as an LED and a light-receiving portion provided with a light-receiving element such as a photodiode (PD), and the light-receiving portion detects only the specular reflection from the photosensitive drum 1.

The optical sensor 900 irradiates the photosensitive drum 1 with infrared light to measure an amount of reflected light from the patch toner image Q in synchronization with the timing at which the patch toner image Q passes under the optical sensor 900. The optical sensor 900 converts the reflected light (infrared light) from the photosensitive drum 1 into an analog electric signal of 0 V to 5 V. The analog electric signal is converted into an 8-bit digital signal by an analogue-digital transforming circuit 114 provided to the control portion 110. The 8-bit digital signal is converted into density information by a density conversion circuit 115.

When the image density of the patch toner image Q formed on the photosensitive drum 1 is changed stepwise in accordance with the area coverage modulation as illustrated in FIG. 7, the output from the optical sensor 900 changes in accordance with the density of the formed patch image as shown in FIG. 8.

Here, the output from the optical sensor 900 in a state in which the toner does not adhere to the photosensitive drum 1 is 5 V, and is read into a 255th level by the analogue-digital transforming circuit 114. As an area coverage ratio of the toner to the pixel formed on the photosensitive drum 1 is increased in accordance with the area coverage modulation, the toner borne-on quantity of the patch toner image Q increases, and the image density becomes higher, while the output from the optical sensor 900 becomes smaller.

A table 115*a* for each color for converting the output from the optical sensor 900 into a density signal for each color is prepared in advance based on characteristics of the optical sensor 900 shown in FIG. 8. The table 115*a* is stored in a storage portion of the density conversion circuit 115. With this operation, the density conversion circuit 115 can refer to the table 115*a* to read the patch image density for each color with high precision and to convert the patch image density into the density information.

(Patch Detection ATR Control) (First Mode)

In order to correct the toner concentration of the developer inside the developing container 22 which has been changed due to the development of the electrostatic image, the patch detection ATR (auto toner replenish) control is executed. In the patch detection ATR control, a toner charge amount Q/M of the developer is accurately detected as appropriate, the toner replenishment is performed in accordance with the change, and the toner charge amount Q/M is controlled at a fixed level at all times, to maintain quality of the image.

The patch detection ATR control is executed for each image formation of 100 sheets. However, the patch detection ATR control may be executed at the timing, for example, each time the replenishment developer is supplied, each time one copy operation is finished, or each time the video count number reaches a predetermined value.

In the patch detection ATR control, the replenishment quantity of the toner is controlled so that the developed image always has a fixed image density in the image formation at a fixed development contrast. If the image density has changed depending on the toner charge amount Q/M, the toner charge amount Q/M is adjusted by the replenishment with the developer. If the toner charge amount Q/M of the developer has changed, and if the toner borne-on quantity of the patch toner image developed at the fixed development contrast has changed, the replenishment quantity of the replenishment developer set in the video count ATR control is corrected.

In the patch detection ATR control, the toner charge amount Q/M of the developer inside the developing device 4 is controlled so that the toner borne-on quantity of the toner image formed on the photosensitive drum 1 becomes fixed when a given electrostatic image is formed on the photosensitive drum 1 and developed into the toner image on a given development condition. In the patch detection ATR control, the ATR patch is formed on the photosensitive drum 1 and detected by the optical sensor 900.

As shown in FIG. 8, the optical sensor 900 has characteristics of a log function, and a slope of a detection result becomes smaller as the toner borne-on quantity becomes larger. In other words, the change in output information from the optical sensor 900 becomes smaller than the change in the toner borne-on quantity, and hence a detection precision of the toner borne-on quantity becomes lower. For that reason, by using a two-lines/one-space pattern as an exposure pattern of the ATR patch as illustrated in FIG. 6A, the area coverage modulation of the ATR patch is lowered, and the toner borne-on quantity (patch image density) is lowered as shown in FIG. 8. The electrostatic image exposed at the time of forming the ATR patch has a resolution of 1,200 dpi, and is set as a coverage modulation pattern of a two-lines/one-space area in a sub-scanning direction.

If the toner borne-on quantity of the ATR patch is insufficient, the toner charge amount Q/M is excessive with respect to the development contrast. Therefore, the replenishment quantity of the replenishment developer is increased to raise the toner concentration of the developer, and a friction opportunity of the toner is reduced to lower the toner charge amount Q/M. When the toner charge amount Q/M is high, the toner charge amount Q/M of the developer is controlled to be lowered by proportionally increasing the replenishment quantity of the replenishment developer obtained in the video count ATR control.

If the toner borne-on quantity of the ATR patch is excessive, the toner charge amount Q/M is insufficient with respect to the development contrast. Therefore, the replenishment quantity of the replenishment developer is reduced to lower the toner concentration of the developer, and the friction opportunity of the toner is increased to raise the toner charge amount Q/M. When the toner charge amount Q/M is low, the toner charge amount Q/M is controlled to be raised by proportionally decreasing the replenishment quantity of the replenishment developer obtained in the video count ATR control.

As illustrated in FIG. 5, the control portion 110 forms an ATR patch Q at an image interval for each image formation of 100 sheets in the continuous image formation. The ATR patch Q is formed in a non-image region (image interval) sandwiched between a trailing edge of the image to be output and a leading edge of the subsequent image. Each color has a cycle of every 100 sheets, and hence the ATR patch Q in any one of colors is formed between images for each continuous image formation of 25 sheets.

The control portion 110 controls the exposure device 3 to write the "patch electrostatic image" being the electrostatic image of the patch toner image onto the photosensitive drum 1, and controls the developing device 4 to perform the development to form the ATR patch. Based on the detection result for the ATR patch which is obtained by the optical sensor 900, the control portion 110 performs replenishment control of the replenishment developer so that the toner borne-on quantity of the ATR patch converges to a target value.

The control portion 110 uses the toner borne-on quantity of the ATR patch for an initial developer as a reference value to obtain a replenishment correction amount Mp from a difference ΔD between the currently-measured value of the toner borne-on quantity of the ATR patch and a reference value. The control portion 110 obtains, in advance, a variation ΔDrate of a measurement result for the toner borne-on quantity of the ATR patch at a time when the toner concentration of the developer inside the developing device 4 deviates from the reference value by 1 g of replenishment developer, and stores the variation ΔDrate in a ROM 113. The control portion 110 calculates the replenishment correction amount Mp of the replenishment developer required for the current measurement by Expression 1.

$$Mp = \Delta D / \Delta Drate \quad \text{(Expression 1)}$$

The replenishment of the replenishment correction amount Mp of replenishment developer can be processed evenly within an execution interval for the patch detection ATR control in order to avoid an abrupt fluctuation of the color tint. This is because, if the obtained replenishment correction amount Mp is collectively supplied at a time of the image formation of the first sheet after execution of the patch detection ATR control, the replenishment control of the replenishment developer is performed to a great extent, which causes an overshoot. For that reason, the replenishment correction amount Mp obtained by Expression 1 is divided by 100 sheets being an execution frequency of the patch detection ATR, and is divided evenly by the number of execution intervals for the patch detection ATR, to thereby process the replenishment correction amount Mp in units of Mp/100. In this manner, the control portion 110 corrects, based on a toner charge amount, the replenishment quantity of the replenishment developer in the video count ATR control.

(Image Density Adjustment)

As illustrated in FIG. 6B, the development contrast VcontG1 changes when the bright-part potential VL of the electrostatic image formed on the photosensitive drum 1 changes due to the change of temperature or the change of humidity in an environment, deterioration of parts, an elapsed time after a startup, or the like. When the development contrast VcontG1 changes, even if the toner charge amount Q/M is maintained at a fixed and unchangeable level, the toner borne-on quantity of the toner image at the time of developing the electrostatic image changes, which causes an output image density to vary. Therefore, the control portion 110 periodically executes image density adjustment (Dmax control) by potential control to reset the development contrast VcontG1 for each image formation of a predetermined number of sheets, thereby causing the density of an output image to be appropriate.

As illustrated in FIG. 6B, in the Dmax control, an exposure output from the exposure device 3 changes in two steps to form the patch electrostatic images having two-step bright-part potentials VLG1 and VLG2 with laser powers W1 and W2. The patch electrostatic images having the bright-part potentials VLG1 and VLG2 form two-step development contrasts VcontG1 and VcontG2 with respect to the direct-current voltage Vdc applied to the developing sleeve 28. The control portion 110 obtains the development contrasts VcontG1 and VcontG2 by subtracting the bright-part potential VL measured by the potential sensor 9 from the direct-current voltage Vdc of an oscillating voltage applied to the developing sleeve 28 (see FIG. 6B). Dmax patches Q1 and Q2 developed with the two-step development contrasts VcontG1 and VcontG2 are different in the toner borne-on quantity in two steps.

The control portion 110 uses the optical sensor 900 to respectively measure the toner borne-on quantities of the Dmax patches Q1 and Q2. The control portion 110 controls a laser light intensity control circuit 190 based on the signal from the optical sensor 900 to change a laser power Wold at the time of the image formation and at a time of patch toner image formation. The control portion 110 performs linear interpolation for the toner borne-on quantity under the laser power W1 and the toner borne-on quantity under the laser power W2. Then, the control portion 110 sets a laser power Wnew, with which the Dmax patch is formed to have an appropriate toner borne-on quantity, between the laser power W1 and the laser power W2. The control portion 110 sets a relationship between the area coverage modulation and the image density applied at the time of normal image formation based on the correction amount of the exposure output for recovering the appropriate toner borne-on quantity of the Dmax patch.

Comparative Example

Figure 9:
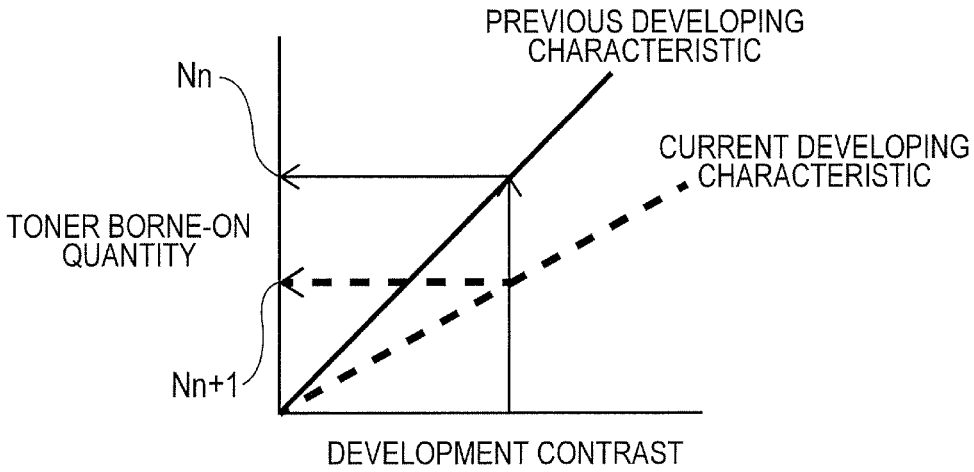
FIG. 9 illustrates a rise in a toner charge amount of the developer.

FIG. 9 is an explanatory diagram of a rise in the toner charge amount of the developer. In conventional patch detection ATR control, the toner borne-on quantity of the patch toner image on the photosensitive drum is detected by the optical sensor, and thus the replenishment control of the toner is performed in a post-processing manner. However, without consideration given to fluctuations in the toner charge amount Q/M due to long-term use of the developer, the replenishment control of the replenishment developer has been generally performed so as to maintain an initially-set developing ability at all times. In a case of a normal use environment, this control can fully handle the situations. The output image having a stable image density can be obtained by this control also in a case of the developer exhibiting extremely small fluctuations in the toner charge amount Q/M even after the long-term use.

However, in recent years, the developing container 22 has been downsized with a decreasing developer quantity along with a downsizing of the image forming apparatus, while a maximum replenishment quantity per unit time of the replenishment developer is increasing along with an increase in productivity of the image forming apparatus. Therefore, a ratio of the replenishment quantity of the replenishment developer to the circulating developer tends to increase to thereby increase the change in the toner charge amount Q/M of the developer.

Therefore, in a case of continuously printing the image having an extremely small image ratio, the toner charge amount Q/M may abruptly rise and the replenishment developer may keep being supplied in order to compensate the rise, resulting in too high toner concentration of the developer. If the toner concentration of the developer is made too high, the quantity of the toner scattered from the developing sleeve 28 increases.

In a case of continuously printing the image having an extremely high image ratio, the toner charge amount Q/M may extremely drop and the replenishment with the replenishment developer may be stopped in order to compensate the drop, resulting in too low toner concentration of the developer. If the toner concentration of the developer is made too low, the density of the output image is lowered.

Therefore, in the conventional patch detection ATR control, as disclosed in Japanese Patent Application Laid-Open No. H10-039608, a magnetic permeability sensor is mounted to a developing container to independently detect the toner concentration of the developer, and the patch detection ATR control is executed only if the toner concentration of the developer falls within a tolerance range (7% to 11%). If the toner concentration exceeds an appropriate range (11%), the replenishment with the replenishment developer is stopped, and if the toner concentration drops below an appropriate range (7%), the replenishment developer is forcibly supplied.

However, in this case, if the toner concentration falls out of the tolerance range, the control for the toner charge amount Q/M no longer functions, and hence reproducibility of the toner borne-on quantity for the same development contrast is lost with regard to both the patch toner image and the normal image. As a result, even without the change in the toner charge amount Q/M, the patch toner image having the toner borne-on quantity far from a normal value corresponding to the toner charge amount Q/M is formed, and the patch detection ATR control itself is disabled. It is natural that, also with regard to a normal output image, ensuring a stability of the image density or the color tint be more difficult than in a case where the patch detection ATR control is normally functioning. If the development contrast at the time of forming the ATR patch is fixed, when the toner charge amount Q/M of the developer keeps changing in one direction, the toner concentration falls out of the tolerance range at an early stage, which disables the image density control with high precision by the patch detection ATR.

Therefore, in the following embodiments, in the replenishment control of the replenishment developer by the patch detection ATR control, the target value of the toner borne-on quantity corresponding to the detected development contrast of the ATR patch on the photosensitive drum 1 changes over time. In order to stabilize the image density, the target value of the toner borne-on quantity corresponding to the predetermined development contrast changes at a predetermined timing, after which the toner replenishment is performed by using the changed toner borne-on quantity as a target. With this operation, even in a case of using the developer whose characteristics change due to the long-term use, it is possible to obtain the image having a high image quality with the density stabilized at all times. In a case where replenishment restriction (including forcible replenishment) is performed, resetting is performed each time the Dmax control is performed, which can realize the stability of the image density.

First Embodiment

Figure 10:
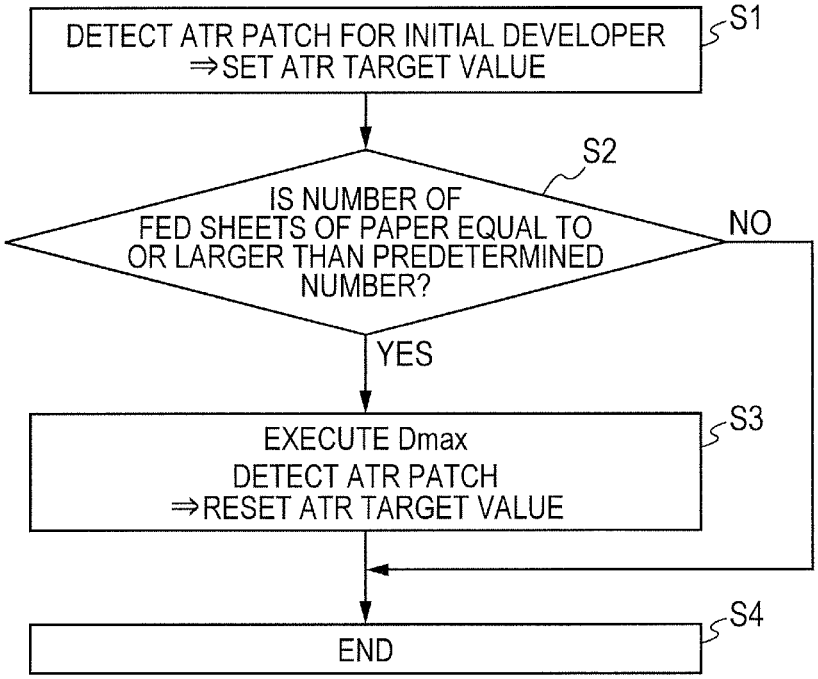
FIG. 10 is a flowchart of toner charge amount control according to a first embodiment of the present invention.

FIG. 10 is a flowchart of toner charge amount control according to a first embodiment of the present invention.

As illustrated in FIG. 4, the exposure device 3 exemplifying an electrostatic image forming unit forms the electrostatic image of an image on the photosensitive drum 1 exemplifying the image bearing member. The developing device 4 causes the developer including the charged toner to be carried on the developing sleeve 28 exemplifying the developer carrying member, and applies a voltage thereto. With this operation, the developing device 4 develops the electrostatic image into the toner image having the toner borne-on quantity corresponding to the development contrast being the potential difference between the potential of the developing sleeve 28 and the potential of the electrostatic image. The hopper 31 exemplifying a replenishment unit replenishes the developing device 4 with the developer in order to compensate the toner consumed in the image formation. In each image formation, the hopper 31 replenishes the developing device 4 with the replenishment developer suitable for the consumed toner quantity which is estimated for each image formation. The control portion 110 adjusts the developer quantity that is to replenish the developing device 4 in each image formation so as to be distributed in units of the image formation of a predetermined number of sheets. The optical sensor exemplifying a detection unit detects a toner image for measurement to be used for control of the image formation, and outputs information corresponding to the toner borne-on quantity.

In the patch detection ATR exemplifying a control method, the exposure device 3 and the developing device 4 are used to set a first development contrast and form the ATR patch exemplifying a first toner image for measurement, and the optical sensor 900 is used to detect it. Based on the detection result, the replenishment quantity of the developer to be supplied from the hopper 31 is controlled so that the toner borne-on quantity of the ATR patch becomes closer to a first target toner borne-on quantity. Each time the image formation of the predetermined number of sheets is performed, the control portion 110 corrects the replenishment quantity of the replenishment developer so that the toner charge amount of the developer inside the developing device 4 becomes closer to a target toner charge.

In the Dmax control exemplifying a maximum density adjustment method, the predetermined development contrast is set (second mode), a second toner image for measurement is formed, and the optical sensor 900 is used to detect it. The development contrast for a maximum image density at the time of the image formation is set so that the toner borne-on quantity of the second toner image for measurement attains a second target toner borne-on quantity corresponding to a maximum density of the output image. Each time a predetermined number of times of control for correcting the replenishment quantity of the replenishment developer are performed, the development contrast used for the image formation is set so that the toner borne-on quantity of the developed toner image becomes closer to the toner borne-on quantity corresponding to the maximum density of the output image.

The control portion 110 exemplifying a setting unit uses the second toner image for measurement exemplifying an adjustment timing in accordance with the Dmax control to execute a third mode (the setting of the first target toner borne-on quantity) during a non-image formation period in which the development contrast is set. At a frequency equal to or lower than ½ of a frequency at which the hopper 31 is controlled based on the detection result for the ATR patch, the first development contrast is set, a third toner image for measurement is formed, and the optical sensor 900 is used to detect it. Then, the control portion 110 sets the detected toner borne-on quantity as the first target toner borne-on quantity. The control portion 110 uses the second toner image for measurement to change the first target toner borne-on quantity in synchronization with a timing at which the development contrast is set. The control portion 110 changes the target toner charge amount so that the toner charge amount of the developer inside the developing device 4 at a time of the Dmax control attains the target toner charge amount. The control portion 110 changes the target toner charge amount so that there is no need to correct the replenishment quantity of the replenishment developer at the time of the Dmax control.

Referring to FIG. 4, as illustrated in FIG. 10, the control portion 110 sets the target value of the toner borne-on quantity of the ATR patch in a case where the developing device 4 is replaced with a new one or a case where the developer inside the developing device 4 is replaced with a new one (S1). The control portion 110 forms the ATR patch subjected to the area coverage modulation as illustrated in FIG. 7 on the photosensitive drum 1 with a predetermined development contrast Vcont preset for each image forming apparatus, and uses the optical sensor 900 to detect the ATR patch. The development contrast Vcont is obtained by subtracting the bright-part potential VL measured by the potential sensor 9 from the direct-current voltage Vdc of the oscillating voltage applied to the developing sleeve 28, and adjustment thereof is performed by changing a laser output from the exposure device 3 (see FIG. 6B).

The control portion 110 obtains the toner borne-on quantity of the ATR patch based on the output information from the optical sensor 900, and sets it as an initial target value of the toner borne-on quantity of the patch toner image which is used for the patch detection ATR control. During a period until the target value is reset in accordance with the subsequent Dmax control, the control portion 110 proportionally increases the replenishment quantity of the replenishment developer unless the toner borne-on quantity of the ATR patch reaches the initial target value, and reduces the replenishment quantity of the replenishment developer if the toner borne-on quantity of the ATR patch exceeds the initial target value.

In a case other than the case where the developing device 4 is replaced with a new one or the case where the developer therein is replaced with a new one, the control portion 110 executes the Dmax control when power to the image forming apparatus 100 is turned on.

In a case other than the Dmax control, for each post-rotation at a time when an image formation job in which the image formation of 1,000th sheet is performed is finished (YES in S2), the control portion 110 executes the Dmax control (S3).

In this embodiment, after the Dmax control is finished, the control portion 110 subsequently resets the target value of the toner borne-on quantity of the ATR patch (S3).

The control portion 110 controls the image forming apparatus so as to attain the same development contrast Vcont as when the initial target value is set, and forms the same ATR patch as when the initial target value is set on the photosensitive drum 1. As shown in FIG. 9, the development contrast Vcont at the time of the ATR patch formation is set to 200 V. The development contrast Vcont of the ATR patch needs to be changed depending on conditions for a machine to be used, but remains the same until the end with the same machine.

The control portion 110 uses the optical sensor 900 to detect the ATR patch, obtains the toner borne-on quantity of the ATR patch based on the output information from the optical sensor 900, and sets it as a new target value of the toner borne-on quantity of the patch toner image for the patch detection ATR control. During a period until the subsequent Dmax control, the control portion 110 proportionally increases the replenishment quantity of the replenishment developer unless the toner borne-on quantity of the ATR patch reaches the new target value, and reduces the replenishment quantity of the replenishment developer if the toner borne-on quantity of the ATR patch exceeds the new target value.

As shown in FIG. 9, the same development contrast is used to form the ATR patch, and hence the toner charge amount Q/M is slightly changed from that obtained when a target value Nn is set previously so that the toner borne-on quantity of the ATR patch differs therefrom. In this case, the control portion 110 sets the measured toner borne-on quantity of the ATR patch as a new target value Nn+1 to be used for the patch detection ATR control until the subsequent Dmax control. In FIG. 9, the toner charge amount Q/M is higher than the previous toner charge amount, and hence the target value Nn+1 is set lower than the previous target value. On the other hand, if the toner charge amount Q/M is lower than the previous toner charge amount, the new target value Nn+1 is set higher than the previous target value Nn.

In other words, unlike the conventional technology, without performing replenishment adjustment of the developer until the toner borne-on quantity of the ATR patch strictly recovers the fixed value, the toner charge amount Q/M at that time point is assumed as a tentative reference, and the replenishment adjustment of the developer is canceled. The patch detection ATR control is executed so as to maintain the toner charge amount Q/M at the time of the current Dmax control until the subsequent Dmax control without recovering the toner charge amount Q/M at the time of the previous Dmax control. Even if there is a change in the toner charge amount Q/M, no problem occurs because the reproducibility of the image density of the output image is maintained at the same level as the previous level by the Dmax control, in other words, at the same level as when the initial target value for the patch detection ATR control is set.

In the first embodiment, the toner charge amount Q/M of the developer is grasped by detecting the toner borne-on quantity on the photosensitive drum 1 corresponding to the development contrast Vcont. The toner charge amount Q/M is determined to be low if the toner borne-on quantity is larger with respect to the predetermined development contrast Vcont, and is determined to be high if the toner borne-on quantity is smaller. Then, the target value of the toner borne-on quantity corresponding to the predetermined development contrast Vcont is changed at the predetermined timing, and after that, the patch detection ATR control is executed by using the changed toner borne-on quantity as the target value.

As shown in FIG. 9, the reproducibility of the toner borne-on quantity of the toner image obtained by developing the electrostatic image exhibiting the same development contrast is impaired between an initial time at which a new developer is used and a time point after an elapsed time during which the toner charge amount Q/M has risen. For that reason, in the first embodiment, the target value relating to the toner borne-on quantity of the ATR patch corresponding to the predetermined development contrast Vcont is reset if there is a change in the toner charge amount Q/M of the developer.

In the conventional patch detection ATR, a toner replenishment quantity is adjusted so that the ATR patch having a fixed target toner borne-on quantity is detected at the fixed development contrast, in other words, that the fixed toner charge amount Q/M is maintained from beginning to end. Therefore, if the image formation having a low image ratio continues and the toner concentration starts to rise, an upper limit value of the toner concentration is reached in a short period of time, and the patch detection ATR can no longer be continued.

In the first embodiment, by correcting the target toner borne-on quantity for each Dmax control, the toner charge amount Q/M at that time point is maintained until the subsequent Dmax control. In the Dmax control, the development contrast used for the image formation is adjusted to cancel an influence of the change of the toner charge amount Q/M, and hence the image density for the image formation is not changed even if there is a change in the toner borne-on quantity of the ATR patch.

In the Dmax control, as a cumulative agitation quantity of the developer in the developing device 4 increases and as the toner charge amount Q/M of the developer becomes higher, the development contrast for realizing the highest density level of the image density is set higher. If the ATR patch is formed at this stage, the toner charge amount Q/M of the developer is high, and hence the toner borne-on quantity of the ATR patch is smaller than the initial or previous patch detection ATR control. Here, if the initial or previous target toner borne-on quantity is used, the developer for replenishment is excessively supplied, and the development contrast set in the Dmax control becomes inappropriate.

For that reason, in the first embodiment, the target toner borne-on quantity is set lower than the initial or previous Dmax control so as to maintain the toner charge amount Q/M of the developer at the time of the Dmax control. This is because the toner borne-on quantity lost by reducing the target toner borne-on quantity has already been compensated by the development contrast that is set high.

According to the first embodiment, a change of the density of the output image involved in the change of the toner charge amount Q/M is canceled by the adjustment of a second development contrast used for the image formation, which causes no problem. The image density conventionally regenerated by adjusting only the toner replenishment quantity is regenerated, in the first embodiment, by adjusting the toner replenishment quantity and the second development contrast. Therefore, there is no need to supply excessive toner or restrict the toner replenishment.

According to the first embodiment, the patch detection ATR control is performed based on the current toner charge amount Q/M of the developer, and hence excessive replenishment of the toner or long-term replenishment stoppage can be avoided even at such a harsh continuous image formation that the toner concentration of the developer keeps changing in one direction. For that reason, a scattering of the toner due to the excessive replenishment of the replenishment developer or a reduction in the image density due to the lowered toner concentration can be suppressed, which can realize the image forming apparatus exhibiting a stable image density.

According to the first embodiment, the target value of the toner borne-on quantity for the patch detection ATR control is gradually changed, and hence the developer of the developing container 22 hardly falls out of the tolerance range of the toner concentration even if the toner charge amount Q/M of the developer keeps changing in one direction. The target value of the toner borne-on quantity in the patch detection ATR control is changed based on the measurement result for the toner borne-on quantity of the ATR patch, which avoids the excessive replenishment of the replenishment developer for the developing container 22 or a disruption of the replenishment. While allowing the gradual change of the toner charge amount Q/M of the developer inside the developing container 22, the change of the density of the output image involved in the change of the toner charge amount Q/M is canceled by the adjustment of the development contrast.

According to the first embodiment, by correcting the target value of the toner borne-on quantity of the ATR patch at the predetermined timing, the excessive replenishment of the replenishment developer or the excessively long replenishment stoppage hardly occurs. Even if the formation of the image having an extremely low image ratio is continuously performed, or even if the formation of the image having an extremely high image ratio is continuously performed, the patch detection ATR control is continued, which enables print output with the stable image density.

In recent years, an agitating speed for the developer inside the developing container has been enhanced along with the increase in the productivity of the image forming apparatus, and hence the developer tends to deteriorate earlier. Therefore, in order to stabilize developing performance, it is necessary to select the toner having such high endurance and exhibiting small fluctuations of the toner charge amount Q/M over a long term, which imposes a limitation on the use of the toner that is conventionally usable. However, according to the first embodiment, the change in the toner concentration is suppressed even if the developer deteriorates earlier, which imposes no limitation on the use of the toner that is conventionally usable.

As illustrated in FIG. 1, the image forming apparatus 100 includes the intermediate transfer belt 5, and hence the optical sensor 900 may be disposed so as to be opposed to the intermediate transfer belt 5. In the patch detection ATR control and the Dmax control, the optical sensor 900 may detect the toner borne-on quantity of the patch toner image Q transferred onto the intermediate transfer belt 5.

In this embodiment, the timing for resetting the target value of the toner borne-on quantity of the ATR patch is described by taking as an example the case where the resetting is subsequently performed after the Dmax control is finished. However, the timing for resetting the target value of the toner borne-on quantity of the ATR patch is not limited thereto. The timing for resetting the target value of the toner borne-on quantity of the ATR patch may be at least a period from a timing at which the ATR patch is formed immediately before the Dmax control is performed until a timing at which the ATR patch is formed immediately after the Dmax control is performed. For example, even after the image formation is performed after the execution of the Dmax control, there is no problem as long as the target value of the toner borne-on quantity of the ATR patch is reset at least before the subsequent ATR patch is formed after the Dmax control is performed. However, from the viewpoint of reducing downtime, it is further preferred that the target value of the toner borne-on quantity of the ATR patch be reset in synchronization with the non-image formation period for performing the Dmax control.

Second Embodiment

Figure 11:
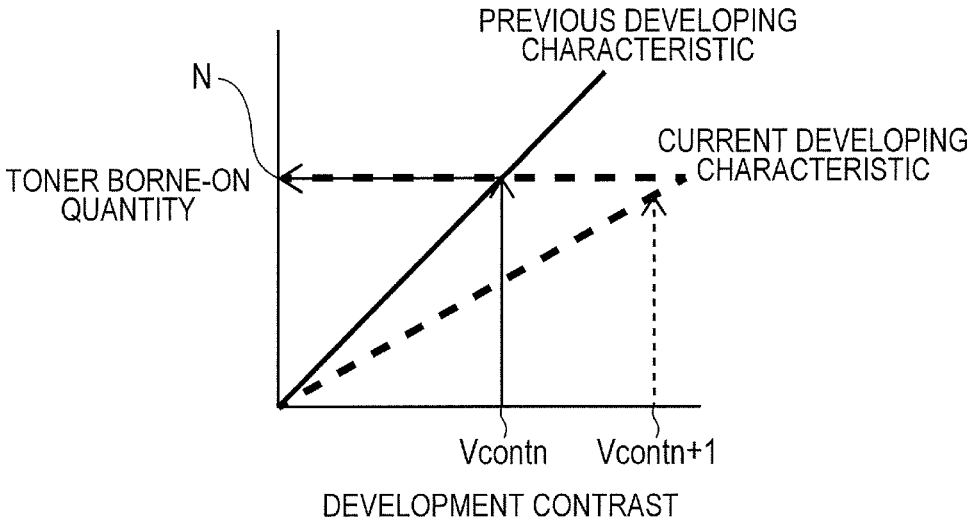
FIG. 11 illustrates setting of a target value for patch detection ATR control according to a second embodiment of the present invention.

FIG. 11 is an explanatory graph illustrating the setting of the target value for patch detection ATR control (a third mode) according to a second embodiment of the present invention. In the first embodiment, the target value of the toner borne-on quantity of the patch detection ATR is changed to lift the replenishment restriction for the replenishment developer, while in the second embodiment, the development contrast at the time of the ATR patch (a third toner image) formation is changed to lift the replenishment restriction for the replenishment developer.

As illustrated in FIG. 4, based on the detection result for the ATR patch, at the frequency equal to or lower than ½ of the frequency at which the hopper 31 is controlled, the control portion 110 exemplifying the setting unit sets the first development contrast, forms the toner image for measurement, and uses the optical sensor 900 to detect it. Then, the control portion 110 sets the first development contrast itself so that the detected toner borne-on quantity becomes closer to the first target toner borne-on quantity.

As illustrated in FIG. 10, in the second embodiment, in the same manner as the first embodiment, in the case where the developing device 4 is replaced with a new one or the case where the developer inside the developing device 4 is replaced with a new one, the initial target value used for the patch detection ATR control is set (S1). After that, each time the Dmax control is executed (YES in S2 and S3), the development contrast at the time of the ATR patch formation is corrected so as to enable the formation of the ATR patch having the same toner borne-on quantity as when the initial target value is set (S3).

As shown in FIG. 11, a development contrast Vcontn used in the previous Dmax control is corrected to a new development contrast Vcontn+1 so that the ATR patch having a toner borne-on quantity N equal to that used in the previous Dmax control can be formed. This correction is executed based on a relationship between the toner borne-on quantity and the development contrast acquired in the current Dmax control.

The development contrast used so far is set as Vcontn. The development contrast for obtaining the toner borne-on quantity N of the ATR patch based on the relationship between the development contrast and the toner borne-on quantity acquired in the previous Dmax control is set as Vcontn'. The development contrast for obtaining the toner borne-on quantity N of the ATR patch based on the relationship between the development contrast and the toner borne-on quantity acquired in the current Dmax control is set as Vcontn+1'. The new development contrast Vcontn+1 at the time of the ATR patch formation is obtained by the following expression.

$$Vcontn+1=Vcontn\times(Vcontn+1'/Vcontn')$$

In other words, in the Dmax control, in order to obtain an appropriate maximum density of each color transferred and fixed, the exposure output from the exposure device 3 is changed to adjust the development contrast of the patch electrostatic image so that the toner borne-on quantity of the Dmax patch becomes a predetermined value. In the second embodiment, in the same manner that the maximum density of the image is obtained in the Dmax control, the exposure output from the exposure device 3 is changed to calculate the development contrast Vcontn+1 so that the toner borne-on quantity of the ATR patch attains the target value (N).

Each time the Dmax control is executed, the development contrast Vcontn+1 at the time of the ATR patch formation is updated. Until the subsequent Dmax control, in the patch detection ATR control, the replenishment quantity of the replenishment developer is reduced to increase the toner charge amount Q/M if the toner borne-on quantity of the ATR patch formed with the development contrast Vcontn+1 is measured to be larger than the toner borne-on quantity N. If the toner borne-on quantity of the ATR patch formed with the development contrast Vcontn+1 is measured to be smaller than the toner borne-on quantity N, the replenishment quantity of the replenishment developer is proportionally increased to lower the toner charge amount Q/M. The patch detection ATR control corresponding to the change of the toner charge amount Q/M of the developer is executed by changing the value of the development contrast Vcontn+1 used when the ATR patch is output without changing the toner borne-on quantity N set as the target value of the ATR patch.

At least until the subsequent Dmax control, the patch detection ATR control is executed so as to maintain the toner charge amount Q/M of the developer at the time of the most recent Dmax control.

The replenishment restriction (including forcible replenishment) for the replenishment quantity of the replenishment developer in accordance with the video count ATR control is executed by using the toner charge amount Q/M of the developer at the time of the most recent Dmax control as a reference. Accordingly, there is no constraint of the toner charge amount Q/M of the developer at the time of setting the initial target value for the patch detection ATR control or of the toner charge amount Q/M of the developer at the time of the Dmax control before the previous Dmax control.

In the replenishment control of the replenishment developer according to the second embodiment, the image density at a time when the image density of the ATR patch is detected as being in an initial state (development contrast: 200 V) is set as a density target value of an ATR pattern. After that, when performing the Dmax control, in the same manner as in the Dmax control, the exposure output of the exposure pattern of the ATR patch is changed and an image forming condition for the ATR patch is detected after the Dmax control.

In the conventional patch detection ATR, the toner replenishment quantity is adjusted so that the ATR patch having the fixed target toner borne-on quantity is detected at the fixed development contrast, in other words, that the fixed toner charge amount Q/M is maintained from beginning to end. Therefore, if the image formation having a low image ratio continues and the toner concentration starts to rise, the upper limit value of the toner concentration is reached in a short period of time, and the patch detection ATR can no longer be continued.

In the replenishment control of the replenishment developer according to the second embodiment, by correcting the development contrast for each Dmax control, the toner charge amount Q/M at that time point is maintained until the subsequent Dmax control. In the Dmax control, the development contrast used for the image formation is adjusted to cancel the influence of the change of the toner charge amount Q/M, and hence the image density for the image formation is not changed even if there is a change in the toner borne-on quantity of the ATR patch.

According to the replenishment control of the replenishment developer according to the second embodiment, even if the developer starts to deteriorate from the initial state, the development contrast used when the ATR patch is output is changed, and hence it is possible to constantly use the same toner borne-on quantity of the ATR patch as the target value for the patch detection ATR control. In the first embodiment, in the patch detection ATR control, the development contrast is set constant over time from the initial state. However, in the second embodiment, the patch detection ATR control corresponding to a deteriorated state of the developer is realized by resetting the target value for the patch detection ATR control.

Third Embodiment

Figure 12:
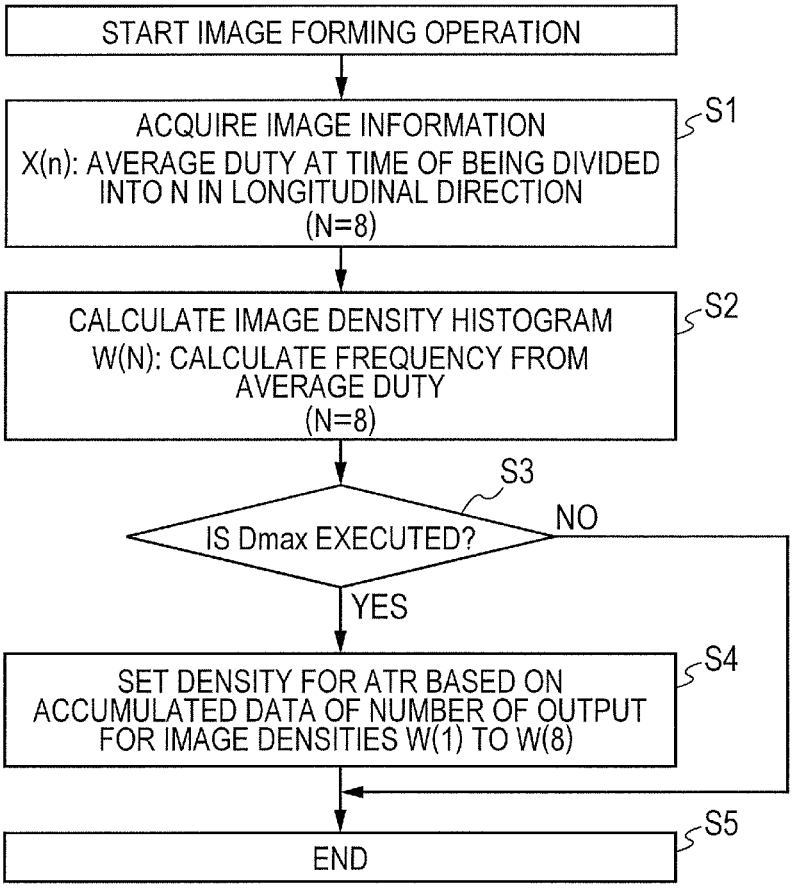
FIG. 12 is a flowchart of toner charge amount control according to a third embodiment of the present invention.

FIG. 12 is a flowchart of toner charge amount control according to a third embodiment of the present invention.

In the second embodiment, the development contrast Vcontn+1 used when the ATR patch is output changes, and the target value of the toner borne-on quantity of the ATR patch to be output has always been a fixed constant value since the initial setting of the target value. In contrast thereto, in the third embodiment, in the updating of the target value for the patch detection ATR control, which is executed for each Dmax control, the toner borne-on quantity of the ATR patch (a third toner image) to be output is updated to the toner borne-on quantity corresponding to the image density used most by a user (a third mode).

In the second embodiment, the ATR patch is output to perform the replenishment control of the replenishment developer so that the toner borne-on quantity of the ATR patch attains the target value. Therefore, the image density, which is obtained when the toner image having the toner borne-on quantity of the ATR patch, in other words, the toner borne-on quantity equal to the toner borne-on quantity of the ATR patch is transferred and fixed onto the recording material, is regenerated with stability at any time. In the case of performing the patch detection ATR control, the image in each color having the toner borne-on quantity equal to that of the ATR patch is output with the most stable image density.

However, an average value of the image density of the respective colors subjected to the image formation, an average value of the toner consumption of the respective colors depending thereon, and therefore the current toner charge amount Q/M of the developer of each color are variously changed depending on the user who uses the image forming apparatus 100 and the image of the image formation job.

In the third embodiment, the density exhibiting the highest frequency at which the image is formed by the user is acquired from video count data, and the toner borne-on quantity corresponding to the density exhibiting the highest frequency is set as the target value of the toner borne-on quantity of the ATR patch. The target value of the toner borne-on quantity of the ATR patch is reset so as to correspond to the image density of the image being actually output by the user. The target value of the toner borne-on quantity of the ATR patch for each color is reset based on a histogram of the image density for the respective colors used in the image formation executed after the previous Dmax control until the current Dmax control.

The control portion 110 sets the area coverage modulation of the electrostatic image of the first toner image for measurement so that the first toner image for measurement that is formed by setting a first contrast has the toner borne-on quantity corresponding to the image density used most by the images output between the previous setting and the current setting.

Referring to FIG. 4, as illustrated in FIG. 12, the control portion 110 divides the image being subjected to the image formation into eight regions in the transporting direction, and obtains which of density ranges in four stages a density range to which an average image density of each of the regions belongs corresponds to (S1). The density ranges in the four stages are defined as a density range A: 00 to 40, a density range B: 41 to 80, a density range C: 80 to C0, and a density range D: C1 to FF, in 8-bit 255-level grayscale (00 to FF) in conformity with visual characteristics of the image density (see FIG. 14).

In each of the eight regions, the control portion 110 accumulates a number of occurrences of each of the density ranges in the four stages with regard to all the image formation between the previous Dmax control and the present (S2).

If the Dmax control is executed (YES in S3), based on cumulative results of the number of occurrences of the density range between the previous Dmax control and the current Dmax control, the control portion 110 obtains the density range exhibiting the largest number of occurrences. Then, the control portion 110 sets the toner borne-on quantity of the toner image of the obtained density range as the target toner borne-on quantity used for the patch detection ATR control until the subsequent Dmax control (S4).

The control portion 110 forms the ATR patch by adjusting the area coverage modulation so as to obtain the same toner borne-on quantity as that of the toner image corresponding to a central value of the density range exhibiting the largest number of occurrences. Then, the control portion 110 uses the optical sensor 900 to detect the formed ATR patch, and sets an output value therefrom as the target toner borne-on quantity used for the patch detection ATR control.

With regard to the ATR patch output for the first time after the Dmax control, a detection value for the patch detection ATR control is obtained in the same manner as in the second embodiment, and the patch detection ATR control is executed by using the detection value as the target value until the subsequent Dmax control is performed. Each time the Dmax control is performed, the toner borne-on quantity of the ATR patch is changed by being determined from data accumulated therebetween. When the image formation of the predetermined number of sheets is performed followed by the execution of the Dmax control, the accumulated data of the densities for the respective regions is calculated, and the toner borne-on quantity of the ATR patch is selected from the number of output for the respective densities based on the accumulated data.

According to the third embodiment, the patch detection ATR control is performed so that the toner borne-on quantity of the ATR patch having the toner borne-on quantity exhibiting a high use frequency is maintained at a fixed level, which enables the user to obtain an output material apparently having a more stable image density.

(Method 1 of Obtaining the Image Density Exhibiting the Highest Frequency)

Figure 13:
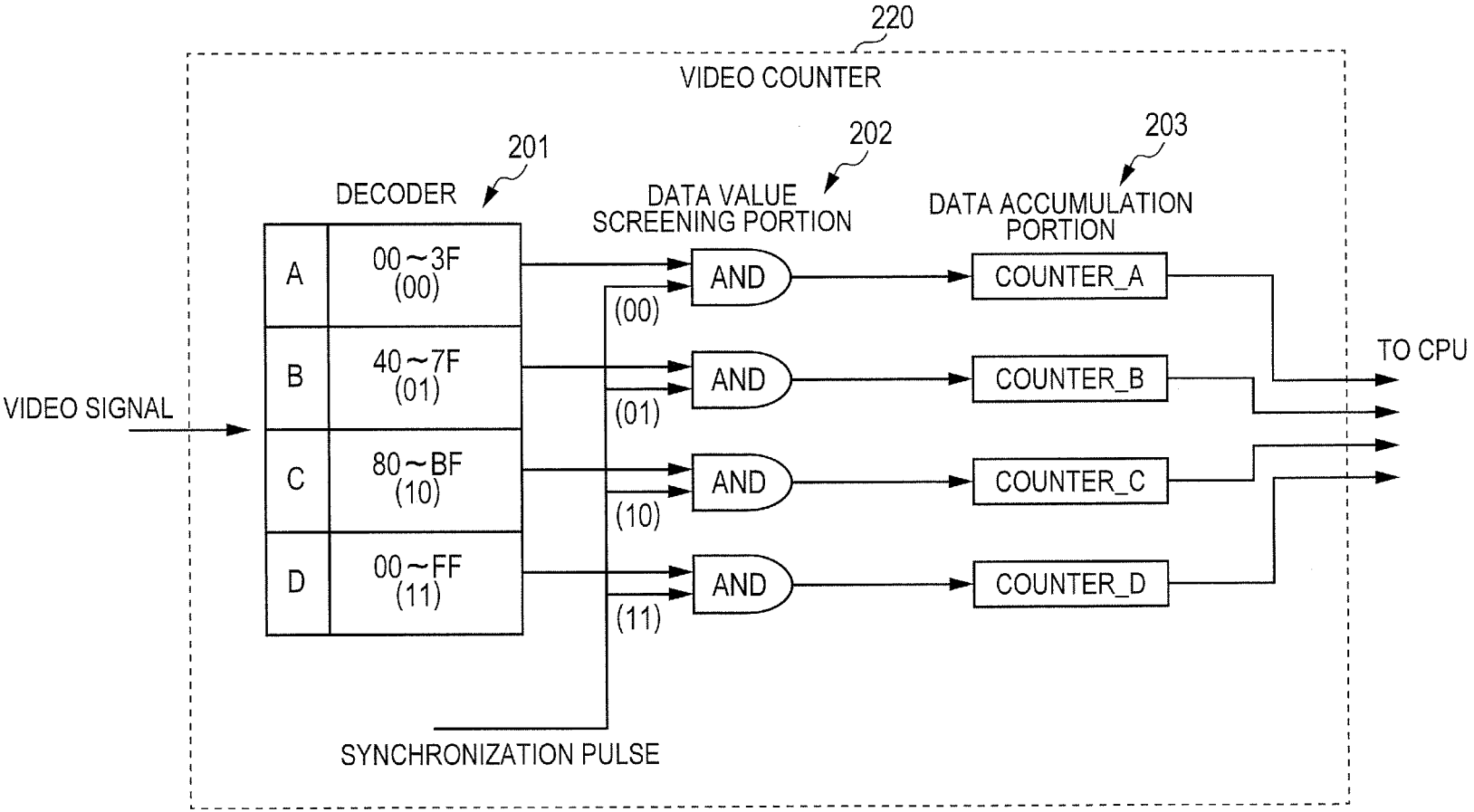
FIG. 13 illustrates a configuration of a video counter.

FIG. 13 is an explanatory diagram of a configuration of a video counter. As illustrated in FIG. 4, the control portion 110 can obtain information of the image density used by the user from the video counter 220.

As illustrated in FIG. 13, the video counter 220 executes split video count as an image density calculation method from image information. A decoder 201 discriminates a duty of each of the pixels of a video signal into the density ranges in the four stages as described above. A data value screening portion 202 outputs any one of the density ranges in the four stages to a data accumulation portion 203 at the timing for each pixel. The data accumulation portion 203 counts the number of pixels for each of the density ranges in the four stages. The control portion 110 (FIG. 4) acquires a count value from the data accumulation portion 203 for each image formation, accumulates the count value, and obtains the image density for the highest use frequency. Then, the target toner borne-on quantity used for the patch detection ATR control is obtained so as to obtain the toner borne-on quantity corresponding to that image density.

(Method 2 of Obtaining the Image Density Exhibiting the Highest Frequency)

As illustrated in FIG. 4, the video counter 220 acquires the image information, and acquires an exposure duty in increments of 1% on a pixel-to-pixel basis in the respective regions obtained by dividing the image into eight in the transporting direction. Table 1 is an example of the split video count in increments of 1% for the eight respective regions in the transporting direction.

TABLE 1

| DUTY [%] | Number of output |
|---|---|
| Data for W(1) | |
| 0 to 1 | 1 |
| 1 to 2 | 2 |
| 2 to 3 | 5 |
| 3 to 4 | 2 |
| 4 to 5 | 4 |
| 5 to 6 | 6 |
| 6 to 7 | 2 |
| . | . |
| . | . |
| . | . |
| 99 to 100 | 0 |
| Data for W(2) | |
| . . . | . . . |
| Data for W(3) | |
| . . . | . . . |

As shown in Table 1, the image is divided into the eight regions W(1), W(2), . . . W(8) in the transporting direction, and the number of pixels for the exposure duty in increments of 1% is counted in the respective regions. Exposure duty data for the highest use frequency obtained in each of the eight regions W(1), W(2), . . . W(8) is counted as one as the exposure duty of that divided region. This is repeated for the regions of (eight regions)×(number of sheets of image formation), and the number of occurrences is summed up in increments of 1% of the exposure duty, to thereby obtain Table 2.

TABLE 2

| Accumulated data for W(1) to W(8) | | Patch selection |
|---|---|---|
| DUTY [%] | Number of output | density [%] |
| 0 to 1 | 5 | 0.5 |
| 1 to 2 | 10 | 1.5 |
| 2 to 3 | 15 | 2.5 |
| 3 to 4 | 24 | 3.5 |
| 4 to 5 | 33 | 4.5 |
| 5 to 6 | 15 | 5.5 |
| 6 to 7 | 20 | 6.5 |
| . | . | . |
| . | . | . |
| . | . | . |
| 99 to 100 | 0 | 99.5 |

As shown in Table 2, the image density for the exposure duty of 4% to 5% exhibiting the number of occurrences of 33, which is the largest number of occurrences, is selected. Then, the target toner borne-on quantity used for the patch detection ATR control is obtained so as to obtain the toner borne-on quantity corresponding to that image density.

(Method 3 of Obtaining the Image Density Exhibiting the Highest Frequency)

Figure 14:
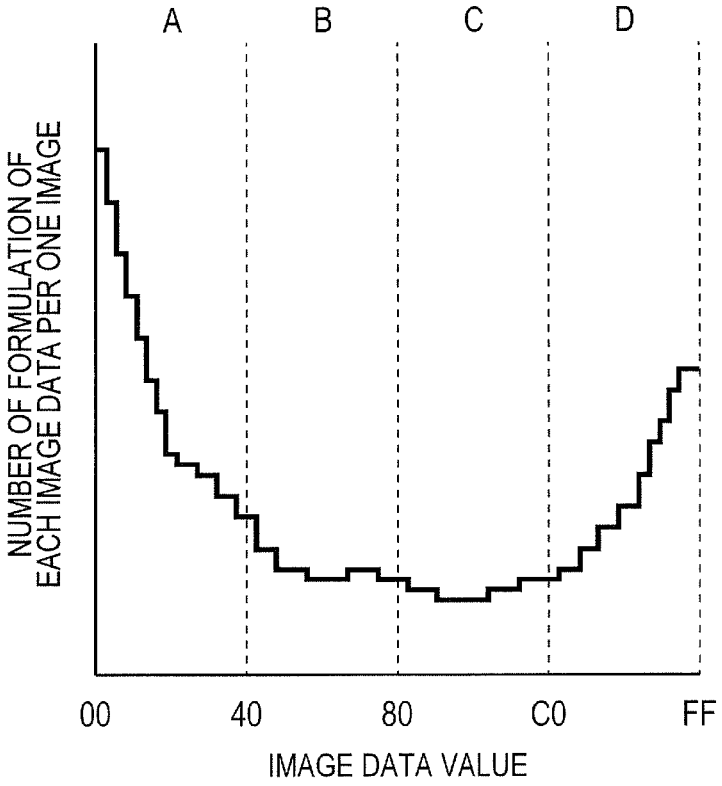
FIG. 14 is a histogram of toner consumption.

FIG. 14 is a histogram of the number of occurrences for each image data value. The image density exhibiting the highest frequency can be obtained not only by the video count but also by processing the image data of the output image.

As shown in FIG. 14, a pixel density exhibiting the highest occurrence frequency is obtained for the respective regions obtained by dividing the image into eight in the transporting direction, and image density data for (number of sheets of image formation)×(eight regions) is acquired, to thereby form the histogram. The histogram is divided into the density ranges in the four stages, to thereby determine which density range exhibits the highest frequency in the image formation. Then, the target toner borne-on quantity used for the patch detection ATR control is obtained so as to obtain the toner borne-on quantity corresponding to that image density.

Hereinabove, the configurations described in the respective embodiments have been described by taking the example in which the timing for resetting the target value of the toner borne-on quantity of the ATR patch is matched with the timing for the Dmax control. However, unless the resetting is executed frequently compared to the frequency at which the Dmax control is executed, the resetting may be executed at an arbitrary timing. The frequency at which the target value of the toner borne-on quantity of the ATR patch can be reset be equal to or lower than the frequency at which the Dmax control is executed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-022282, filed Feb. 3, 2012, which is hereby incorporated by reference herein in its entirety.

What is claimed is:

1. An image forming apparatus, comprising:

an image bearing member;

an electrostatic image forming device which forms an electrostatic image on the image bearing member;

a developing device which develops the electrostatic image on the image bearing member by causing a developer including toner to be carried on a developer carrying member;

a replenishment device which replenishes the developing device with the developer;

a sensor which detects a toner image and which outputs information corresponding to a toner borne-on quantity; and a control portion controlling an operation of the replenishment device based on a detection result of a first image having an intermediate density level detected by the sensor and a target value, and controlling a development contrast of a maximum image density based on a detection result of a second image detected by the sensor, wherein the control portion controls the target value or the development contrast of the first image based on a detection result of a third image detected by the sensor, and wherein the third image is formed in response to the timing of forming the second image.

2. An image forming apparatus according to claim 1, wherein the control portion forms the third image after forming the second image and before executing a subsequent image forming operation.

3. An image forming apparatus according to claim 1, wherein a development contrast of the third image is the same as a development contrast of the first image, and the control portion sets the target value based on a detection result of the third image detected by the sensor.

* * * * *